US005232330A

United States Patent [19]

Rae et al.

[11] Patent Number: 5,232,330

[45] Date of Patent: Aug. 3, 1993

[54] STRUCTURE FOR MOUNTING HYDRAULIC HOSES FOR A POWER LOADER

[75] Inventors: Rory Rae, Port Colborne; David A. Willer, Fonthill, both of Canada

[73] Assignee: Deere & Company, Moline, Ill.

[21] Appl. No.: 905,715

[22] Filed: Jun. 29, 1992

[51] Int. Cl.[5] ..... E02F 3/627

[52] U.S. Cl. ..... 414/686; 414/918

[58] Field of Search ..... 414/918, 686, 685; 248/51, 52; 403/316, 317, 320

[56] References Cited

U.S. PATENT DOCUMENTS

| | | | |
|---|---|---|---|
| 3,292,804 | 12/1966 | Veneman | 414/918 X |
| 3,805,980 | 4/1974 | Kisaka | 414/686 |
| 3,982,643 | 9/1976 | MacGregor et al. | 414/686 |
| 4,798,511 | 1/1989 | Kaczmarczyk et al. . | |
| 5,135,347 | 8/1992 | Kaczmarczyk et al. | 414/686 |

OTHER PUBLICATIONS

Operator's Manual for Model 80 Deere Loader, cover page and p. 25-2.

*Primary Examiner*—Frank E. Werner
*Assistant Examiner*—Donald W. Underwood

[57] ABSTRACT

An arm of a tractor-mounted loader is coupled to the top of a loader mast having a bottom end received in a pocket formed at an outboard area of a horizontal base plate of a loader mounting frame connected to one side of the tractor. A quick coupler support bracket is mounted to the base plate inboard of the pocket. Supported by and projecting upwardly from a horizontal fitting mounting plate of the support bracket are respective quick coupler halves forming ends of a first set of hoses that are coupled to the tractor hydraulic system. The first set of hoses extend through a hose passage, provided in a rear wall of a walled structure joined to and cooperating with the base plate so as to form a cavity therebeneath, and through a set of fitting openings provided in the fitting mounting plate. A second set of hoses extend from the rear of the arm and has a second set of quick coupler halves connected to the first set of quick coupler halves.

11 Claims, 4 Drawing Sheets

STRUCTURE FOR MOUNTING HYDRAULIC HOSES FOR A POWER LOADER

BACKGROUND OF THE INVENTION

The present invention relates to power loaders and more specifically relates to structure for mounting the hydraulic hoses for such loaders.

Tractor-mounted loaders are usually equipped with boom and bucket or tilt cylinders which often are used to aid in attaching and detaching the loader to and from the tractor. In order to accommodate these operations, it is known to equip the loader with first and second sets of hoses that are interconnected by quick disconnect couplers, more simply called quick couplers. The first set of hoses has first ends coupled to the tractor hydraulic system and second ends defined by male quick coupler halves that are mounted to a bracket carried by the loader frame. The second set of hoses has first ends coupled to the rear ends of steel tubes carried by one of the loader arms and has second ends defined by female quick coupler halves that are coupled to the male quick coupler halves of the first set of hoses. The second set of hoses have a length permitting them to be connected to the quick coupler halves of the first set of hoses while the loader is in a location close to but disconnected from the loader mounting frame. A structure showing quick coupler halves mounted to the loader mounting frame is embodied in the Model 80 Loader marketed by Deere & Company. A structure showing loader hoses of a length for connection to an ICV mounted to the tractor in a location adjacent the loader mounting frame is disclosed in U.S. patent application Ser. No. 07/502,071 filed on 30 Mar. 1990 (now U.S. Pat. No. 5,135,347, issued on 14 Aug. 1992) and having the same assignee as the present application.

The hydraulic hose arrangements associated with the known tractor-mounted loaders suffer from one or more of the disadvantages of (1) having hydraulic quick couplers that are either exposed such as to be vulnerable to damage, or being tucked away where they are difficult to use; (2) having hydraulic couplers positioned such that excessive hose length is required for attaching and detaching or parking the loader; and (3) having hydraulic couplers and hoses located such that they are relatively messy in appearance and/or located where they are prone to collecting mud or other debris.

SUMMARY OF THE INVENTION

According to the present invention there is provided a tractor-mounted loader having an improved hydraulic hose arrangement.

An object of the invention is to provide a tractor-mounted loader wherein a bracket for supporting quick couplers is integrated with the loader mounting frame so as to be conveniently positioned for easy use and such that the couplers and associated hydraulic hoses conveying fluid to and from the couplers are protected from damage.

Another object of the invention is to provide a quick coupler support bracket located so that the lengths of hoses, extending between the loader and the quick coupler support bracket, required for attaching and detaching or parking the loader, is minimized.

Yet another object of the invention is to provide a hose arrangement for a tractor-mounted loader having a quick coupler support bracket located so that hose and coupler arrangement is neat in appearance.

These and other objects of the invention are achieved by mounting quick coupler halves, forming the terminal ends of hoses extending from the tractor hydraulic system, preferably to a coupler support bracket carried by the loader mounting frame at a location immediately inwardly of one of the loader support masts but which may be connected directly to the mounting frame at the same inward location. The loader mounting frame includes a hollow cavity defined by a wall structure located beneath and cooperating with a horizontal base plate of the frame. The wall structure includes a rear wall provided with a hose passage and the base plate includes a plurality of hose openings through which the hoses are routed. Coupler halves at the terminal ends of the hoses are coupled to bulkhead fittings positioned within individual hose openings provided in a horizontal plate of the support bracket, the fittings and being preferably fixed to the support bracket but being fixable directly to the base plate in the absence of the support bracket.

The above-mentioned and other objects will become apparent from a reading of the following description together with the appended drawings.

DESCRIPTION OF THE PREFERRED EMBODIMENT

Figure 1:
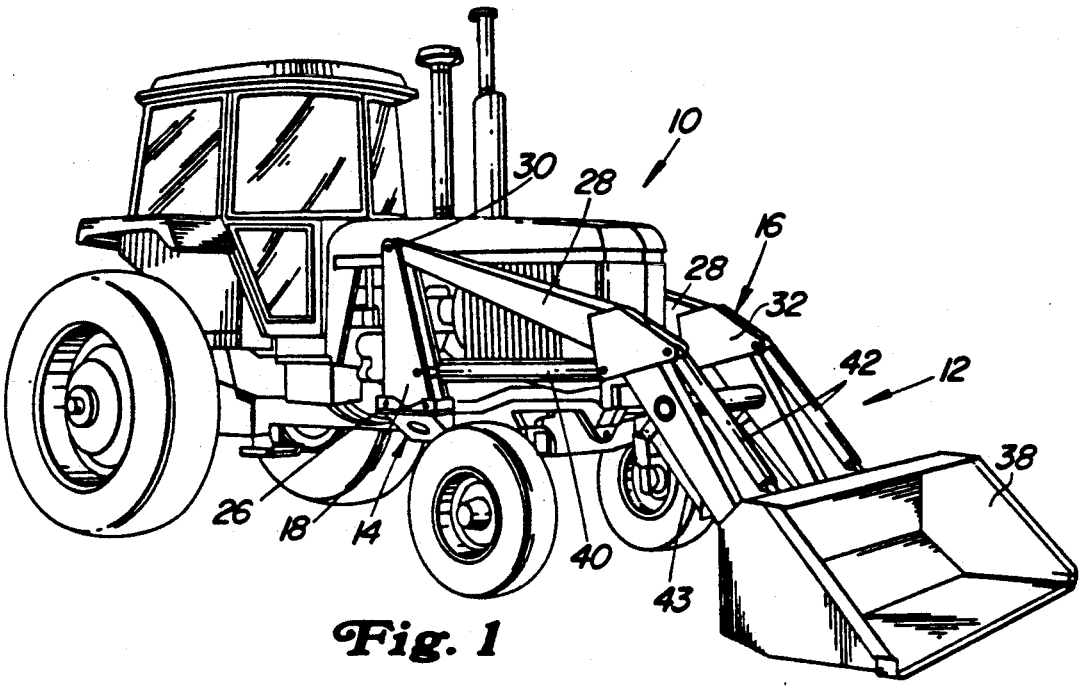
FIG. 1 is a right front perspective view of a tractor-mounted loader embodying the hydraulic hose mounting arrangement of the present invention.
Figure 2:
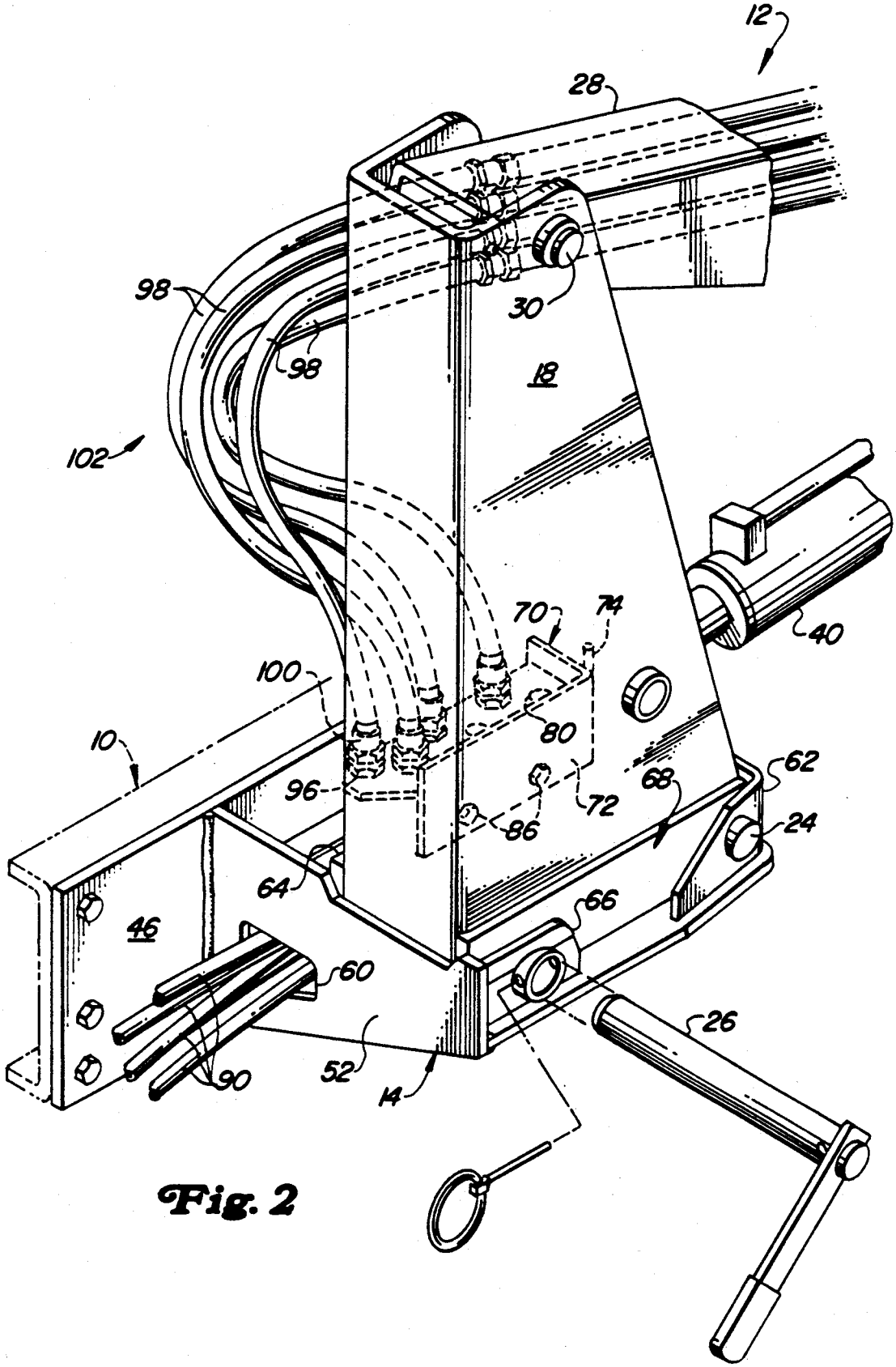
FIG. 2 is a right rear perspective view showing the right-hand loader mast coupled to the right-hand loader frame and showing the hydraulic hoses that are carried by the loader arm.
Figure 3:
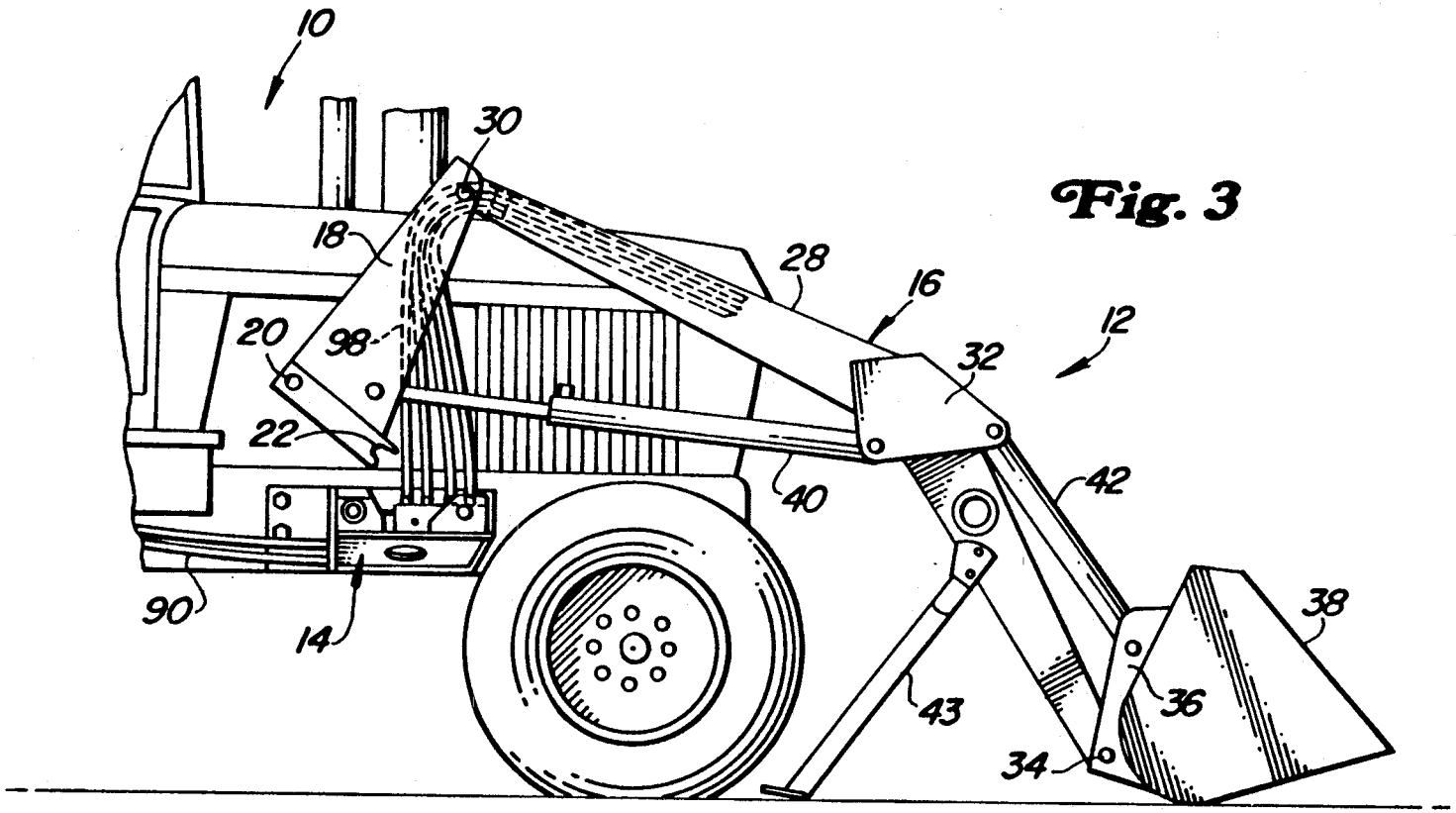
FIG. 3 is a right side elevational view showing the loader detached from the tractor except for loader-carried hoses having coupler halves which remain connected to the quick coupler halves mounted to the loader mounting frame.

Referring now to FIGS. 1–3, therein is shown a tractor 10 having a longitudinal main frame having a loader 12 mounted thereon. The loader 12 includes a loader mounting structure comprising right and left mounting frames 14 secured to opposite sides of the main frame of the tractor. Only the right mounting frame 14 is illustrated and it is to be understood that the left frame is a mirror image of the right frame. The loader 12 further includes a boom 16 comprising a pair of transversely spaced, upright masts 18 having lower ends (FIG. 3) which are each provided with a transverse mounting bore 20, located in a lower rear corner thereof, and with a forwardly opening receptacle 22, located ahead of the bore 20 in a lower front corner thereof. Each mast 18 has its lower end releasably secured to a respective one of the right and left mounting frames 14 by a mounting pin 24 forming a part of a respective frame 14 and being received in the receptacle, and by a coupling pin 26 (FIG. 2) releasably received in the mast mounting bore 20. The loader 12 includes arms 28 respectively pivotally connected, as at pins 30, to upper ends of the masts 18 for rocking in a conventional manner about a transverse axis defined by the pivot pins 30. The boom arms 28 extend forwardly from the masts 18 to cylinder mounting plates 32 and then downwardly to forward ends which are pivotally connected, as by pins 34 (FIG. 3), to lower locations of upright brackets 36 forming part of an attachment, here shown as a bucket 38 but which could be any of a variety of other attachments adapted for being carried by the arms 28. Boom cylinders 40 are connected between lower locations of the masts 18 and the cylinder mounting plates 32 to swing the arms 28 vertically about the pins 30. Tilt cylinders 42 are connected between the cylinder mounting plates 32 and upper locations of the attachment brackets 36 and serve to rock the bucket 38 about the pivots 34 to various positions during operation or parking of the loader.

Parking stands 43 are pivotally connected to the boom arms 28 below the cylinder mounting plates 32 for movement between raised stored positions (FIG. 1), closely adjacent the boom arms, and park positions (FIG. 3) angled rearwardly from boom arms. With the stands 43 pinned in the park positions, the detached loader 12 is free-standing and is supported entirely by the stands and the bucket 38.

Figure 4:
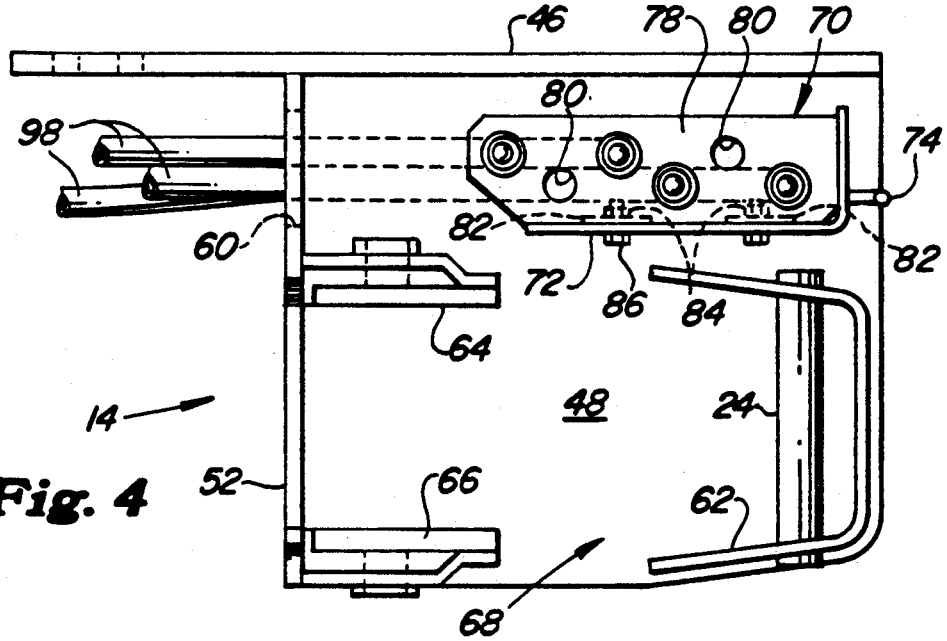
FIG. 4 is a top plan view of the right-hand loader mounting frame with the bracket for supporting the quick coupler halves of tractor-mounted hoses being secured thereto.
Figure 5:
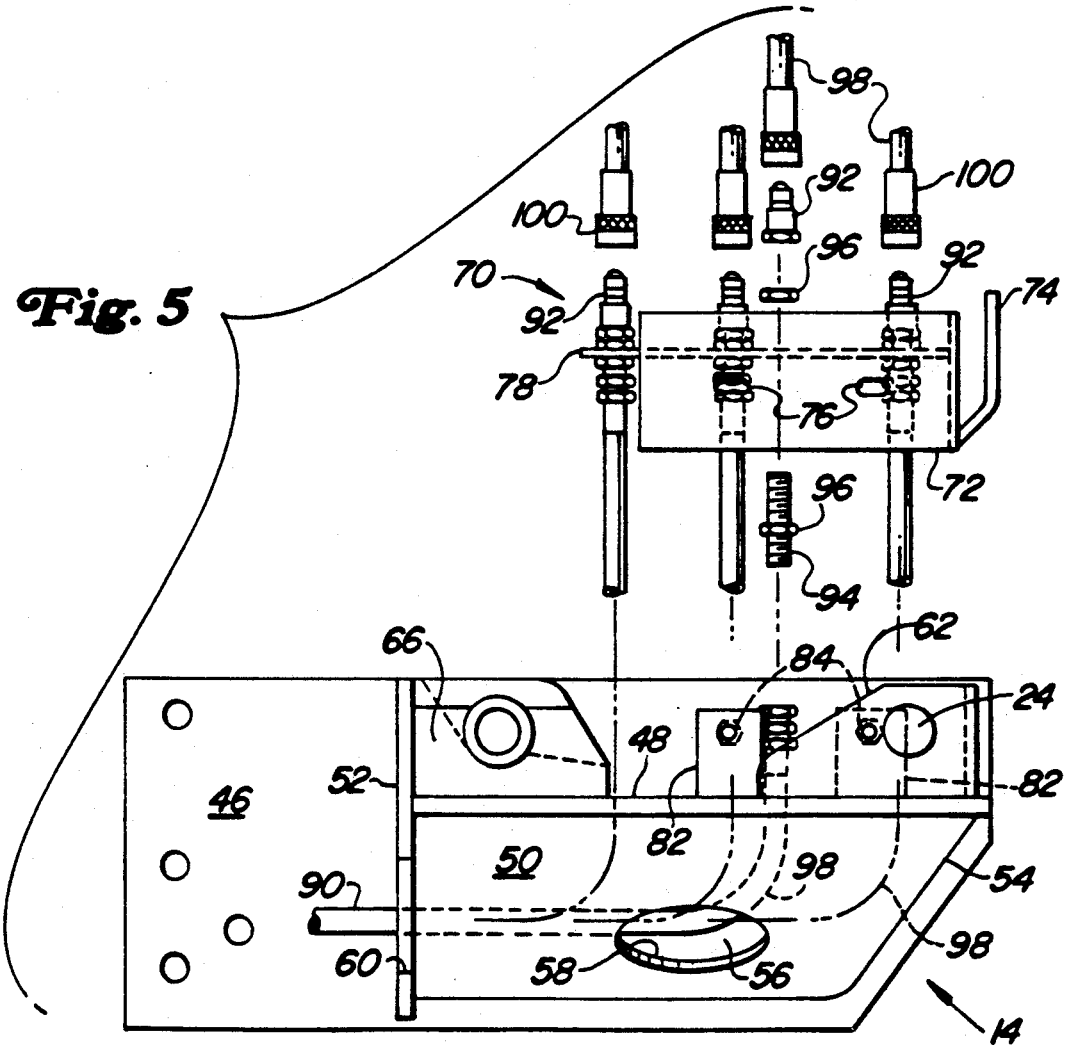
FIG. 5 is an exploded right side elevational view of the loader mounting frame shown in FIG. 4.

The mounting frame 14 (see FIGS. 4 & 5) is in the form of a weldment including a vertical mounting plate 46 containing holes for receiving bolts for securing the frame 14 to the tractor frame just behind the front wheels (FIG. 1). A horizontal base plate 48 is welded to and projects outwardly from the mounting plate 46. A gusset or brace 50 has a main portion that extends upwardly and outwardly from the bottom end of the mounting plate 46 to a connection with the outer edge of the base plate 48. A vertical rear wall 52 is welded to and extends outwardly from the mounting plate 46 and is welded to the aft ends of the base plate 48 and brace 50. The main portion of the brace 50 is joined to a forward end 54 that is angled relative to the main portion and welded to the mounting and base plates 46 and 48, respectively. Thus, the mounting plate, base plate, brace and rear wall cooperate to define an enclosure 56. Access to the enclosure 56 is provided by a circular opening 58 in the main portion of the brace 50 and by a hose passage 60 provided in the rear wall 52. Welded to an outer forward location of the base plate 48 is a rearwardly opening U-shaped pin bracket 62 having the mounting pin 24 welded in place in transversely aligned bores provided in the legs of the bracket. Welded to an outer rear location of the base plate 48 and to the rear wall 52 are inner and outer lugs 64 and 66, respectively, having aligned bores for releasably receiving the mounting pin 26. Thus, the rear wall 52 cooperates with lugs 64 and 66 and with the U-shaped bracket 62 to define a substantially rectangular pocket 68 for receiving the bottom end of the mast 22.

Mounted to the base plate 48 at a location inboard of the pocket 68 is a quick coupler support bracket 70, having a purpose explained below. The bracket 70 includes front and outer sides defined by an L-shaped strap 72, with the front side having an upwardly projecting pressure relief pin 74 welded thereto and with the outer side being provided with a pair of elongate mounting holes 76. Welded to the strap 72 at a location spaced below an upper edge thereof is a horizontal fitting mounting plate 78 containing six fitting mounting holes 80 arranged in staggered relationship to each other along the length of the plate. Disposed below the plate 78 and welded to the loader mounting frame base plate 48 are a pair of fore-and-aft aligned mounting tabs 82 that are provided with holes, that are aligned with the mounting holes 76, and with nuts 84 welded in place for receiving threaded ends of screw fasteners 86 inserted through the mounting holes 76. Located in the base plate 48 in substantial vertical alignment with the fitting mounting holes 80 are a set of six holes 88 (FIG. 6) that serve as hose passages when the fitting support bracket 70 is used or which may serve as fitting mounting holes in the absence of the bracket 70.

Figure 6:
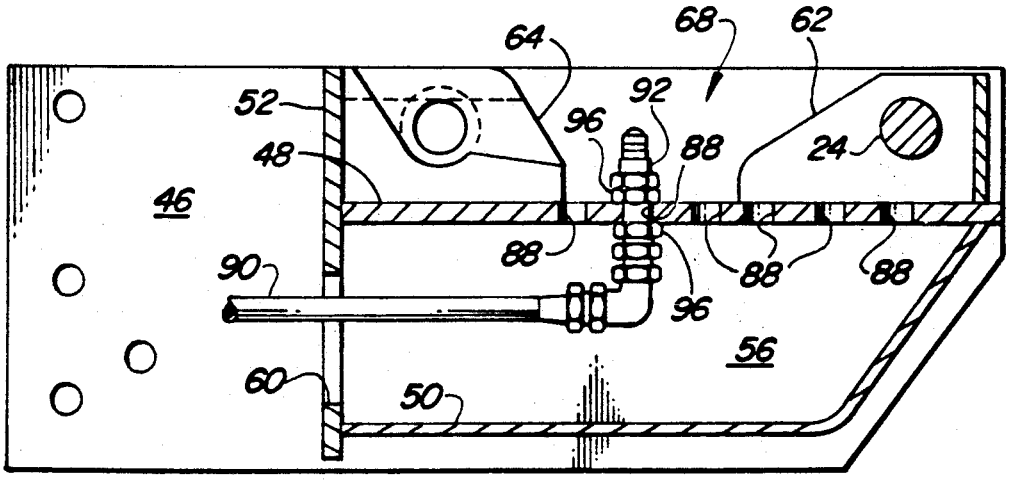
FIG. 6 is sectional view similar to FIG. 5 but omitting the bracket and showing the quick coupler mounted directly to the loader mounting frame.

The tractor 10 is provided with a hydraulic system which is connected to the loader 12 for controlled operation of the boom and tilt cylinders 40 and 42, respectively, which cylinders may be operated, in a manner described in detail in the aforementioned U.S. patent application Ser. No. 07/502,071, for aiding in detaching the loader from and attaching the loader to the tractor. Specifically, the tractor 10 is equipped with integral and/or independent control valves (not visible) to which first ends of a plurality of hoses 90 are coupled. The hoses 90 are routed into the mounting frame cavity 56 via hose passage 60. The person installing the hoses 90 may reach through the access opening 58 and guide male quick coupler halves 92 at the ends of the hoses through respective ones of the hose openings 88 in the base plate 48 and through respective ones of the fitting openings 80 in the coupler support plate 78 of the bracket 70. At this time, the bracket 70 would be detached from the frame 14 for easier access. The quick coupler halves 92 are each coupled to a bulkhead fitting 94 including upper and lower jam nuts 96 engaged with upper and lower surfaces of the plate 78 fixing the quick coupler halves 92 in upwardly projecting positions. The bracket 70 would then be mounted into place on the base plate 48. Although it is preferred that the mounting frame 14 be equipped with the coupler support bracket 70, so as to simplify the installation of the bulkhead fittings by detachment then reattachment of the bracket, is to be noted that in the absence of the mounting bracket 70, the bulkhead fittings may be connected directly to the base plate 48 by tightening the jam nuts 96 against opposite sides of the base plate (FIG. 6). Further, it is to be noted that while only four of the hose openings 88 and four of the fitting holes 80 are utilized in the disclosed embodiment, the remaining two openings 88 and holes 80 would be employed for accommodating two additional hoses that would be required if, for example, the attachment included a third hydraulically operated function, such as a grapple, for example.

The loader is equipped with a set of steel tubes (not visible) which are mounted to and extend along the inside of the right loader arm 28. Coupled to the rearward ends of the tubes is a set of hydraulic hoses 98 (FIGS. 2 and 3) having female quick coupler halves 100 (FIG. 2) at their rear ends which are coupled to the male coupler halves 92. When the set of hoses 98 are disconnected from the set of hoses 90, the valve inside the each of the coupler halves 100 may be opened by engaging it with the pressure relief pin 74 to relieve the hydraulic pressure from the hoses 98. It is here noted that dust covers (not shown) would normally be tethered to the coupler halves 100 for covering the ends thereof when the hoses are to be left disconnected from the coupler halves 92 for any length of time, as when the loader 12 is to be parked, for example.

Referring to FIG. 2, it can be seen that with the loader 12 mounted on the tractor 10, the mast 18 protects the lower section of the hoses 98 and the quick coupler halves 92 and 100 from damage. Further, it will be appreciated that the vertical orientation of the coupler halves results in there being only a minimal surface area presented for the collection of debris. Also, it can be seen that the hoses 98 form a relatively small loop 102 disposed in a substantially debris-shedding and debris-free location. The loop 102 is formed by a minimum hose length required for enabling the loader 12 to be placed in its parked position shown in FIG. 3 while permitting the hoses 90 and 98 to be interconnected so that the boom and bucket cylinders 40 and 42 may be used in aiding the attachment or detachment of the loader.

We claim:

1. In a loader for a tractor having a longitudinally extending main frame, the loader comprising a loader mounting structure secured to the opposite sides of the tractor main frame and including a horizontal base plate extending outwardly from opposite sides of the tractor main frame, each base plate supporting coupling structure defining an upwardly opening pocket located outboard on the base plate from the tractor frame, an upright mast having a lower end releasably secured in each pocket, a loader arm pivotally attached to each mast, a boom cylinder coupled between each mast and each arm for swinging the latter vertically, an attachment pivotally mounted to forward ends of the arms, an attachment cylinder coupled between each arm and the attachment for pivoting the latter relative to the arms, and a first set of hydraulic hoses carried by one of the loader arms and having a first set of quick coupler halves at an end thereof coupled for receiving pressurized fluid from and returning exhaust fluid to the hydraulic system of the tractor, an improved hose mounting structure comprising: one of said base plates being adjacent said one loader arm and including a set of hose openings located inboard of said pocket; a second set of hydraulic hoses extending from the hydraulic system of the tractor and through respective ones of the plurality of hose openings, the second set of hoses respectively terminating at a second set of quick coupler halves; a bulkhead fitting being coupled to each of the second set of quick coupler halves and received in a respective one of the hose openings and including means securing the bulkhead fitting to the base plate such that the second set of quick coupler halves project upwardly from the latter; and said first and second sets of quick coupler halves being coupled to each other.

2. In a loader for a tractor having a longitudinally extending main frame, the loader comprising a loader mounting structure secured to the opposite sides of the tractor main frame and including a horizontal base plate extending outwardly from opposite sides of the tractor main frame, each base plate supporting coupling structure defining an upwardly opening pocket located outboard on the base plate from the tractor frame, an upright mast having a lower end releasably secured in each pocket, a loader arm pivotally attached to each mast, a boom cylinder coupled between each mast and each arm for swinging the latter vertically, an attachment pivotally mounted to forward ends of the arms, an attachment cylinder coupled between each arm and the attachment for pivoting the latter relative to the arms, and a first set of hydraulic hoses carried by one of the loader arms and having a first set of quick coupler halves at an end thereof coupled for receiving pressurized fluid from and returning exhaust fluid to the hydraulic system of the tractor, an improved hose mounting structure comprising: one of said base plates being adjacent said one loader arm and including a set of hose openings located inboard of said pocket; a second set of hydraulic hoses extending from the hydraulic system of the tractor and through respective ones of the plurality of hose openings; a quick coupler support bracket releasably secured to said one of the base plates inboard of said pocket; said support bracket including a horizontal fitting mounting plate spaced above the hose openings in said one of the base plates and being provided with a set of fitting openings in substantial vertical alignment with respective ones of said hose openings; said second set of hoses respectively terminating at a second set of quick coupler halves; a bulkhead fitting being coupled to each of the second set of quick coupler halves and received in a respective one of the fitting openings and including means securing the bulkhead fitting to said fitting mounting plate such that the second set of quick coupler halves project upwardly from the latter; and said first and second sets of quick coupler halves being coupled to each other.

3. The invention defined in claim 2 wherein said fitting support bracket includes an L-shaped strap disposed with a lower edge thereof in engagement with said one of said base plates; said fitting mounting plate being substantially rectangular and having contiguous sides fixed to said L-shaped strap; said L-shaped strap being provided with a pair of mounting holes; a pair of upright tabs being fixed to said one of said base plates at locations placing them adjacent said mounting holes; and fastener means releasably securing the L-shaped strap to said pair of upright tabs.

4. The invention defined claim 2 in wherein said fitting support bracket includes an upwardly projecting pressure relief pin; and said first set of quick coupler halves being female coupler halves whereby said first set of quick coupler halves may be engaged with said pin to relieve pressure from said first set of hydraulic hoses.

5. The invention defined in claim 1 wherein said first set of hydraulic hoses has length which is a minimum length required for permitting the loader to be positioned in a park position wherein the masts are located just ahead of the pockets located on the base plates while the first set of quick coupler halves is connected to the second set of quick coupler halves.

6. The invention defined in claim 1 wherein said loader mounting structure includes right and left mounting frames; said mounting frames each including an upright mounting plate secured to the tractor main frame; said base plates being joined to and extending outwardly from the mounting plates; and said hose openings being located between the mounting plate and pocket associated with said one of said base plates.

7. The invention defined in claim 1 wherein said loader mounting structure includes a wall structure joined to each base plate and cooperating therewith to form a cavity therebeneath; said wall structure that is associated with said one of said base plates having a rear wall that is provided with a hose passage; and said second set of hoses extending through said cavity via said hose passage.

8. The invention defined in claim 2 wherein said loader mounting structure includes a wall structure joined to each base plate and cooperating therewith to form a cavity therebeneath; said wall structure that is associated with said one of said base plates having a rear wall that is provided with a hose passage; and said second set of hoses extending through said cavity via said hose passage.

9. The invention defined in claim 8 wherein said coupler support bracket includes an L-shaped strap disposed with a lower edge thereof in engagement with said one of said base plates; said fitting mounting plate being substantially rectangular and having contiguous sides fixed to said L-shaped strap; said L-shaped strap being provided with a pair of mounting holes; a pair of upright tabs being fixed to said one of said base plates at locations placing them adjacent said mounting holes; and fastener means releasably securing the L-shaped strap to said pair of upright tabs.

10. The invention defined in claim 8 wherein said coupler support bracket includes an upwardly projecting pressure relief pin; and said first set of quick coupler halves being female coupler halves whereby said first set of quick coupler halves may be engaged with said pin to relieve pressure from said first set of hydraulic hoses.

11. The invention defined in claim 8 wherein said first set of hydraulic hoses has length which is a minimum length required for permitting the loader to be positioned in a park position wherein the masts are located just ahead of the pockets located on the base plates while the first set of quick coupler halves is connected to the second set of quick coupler halves.

* * * * *